US006086399A

United States Patent [19]

Matsunaga et al.

[11] Patent Number: 6,086,399

[45] Date of Patent: Jul. 11, 2000

[54] EARTH JOINT CONNECTOR

[75] Inventors: Hideki Matsunaga, Yokkaichi; Kazuhiro Aoki; Masao Shibata, both of Aichi-ken, all of Japan

[73] Assignee: Sumitomo Wiring Systems, Ltd., Japan

[21] Appl. No.: 09/008,807

[22] Filed: Jan. 20, 1998

[30] Foreign Application Priority Data

Jan. 23, 1997 [JP] Japan ..... 9-010448

[51] Int. Cl.[7] ..... H01R 13/28

[52] U.S. Cl. ..... 439/287

[58] Field of Search ..... 439/92, 287, 288; 174/51, 84 C

[56] References Cited

U.S. PATENT DOCUMENTS

| | | | |
|---|---|---|---|
| 3,011,144 | 11/1961 | Armentrout | 439/92 |
| 3,557,746 | 1/1971 | Jungblut | 116/295 |
| 5,326,273 | 7/1994 | Kamon et al. | 439/92 |
| 5,433,628 | 7/1995 | Sadaishi et al. . | |
| 5,558,531 | 9/1996 | Ikeda et al. . | |
| 5,688,131 | 11/1997 | Byfield, Jr. | 439/92 |
| 5,865,637 | 2/1999 | Shinozaki et al. | 439/287 |
| 5,934,923 | 8/1999 | Matsuoka et al. | 439/287 |

FOREIGN PATENT DOCUMENTS

| | | |
|---|---|---|
| 2708795 | 2/1995 | France . |
| 6-84565 | 3/1994 | Japan . |

*Primary Examiner*—Steven L. Stephan
*Assistant Examiner*—Barry M. L. Standig
*Attorney, Agent, or Firm*—Banner & Witcoff, Ltd.

[57] ABSTRACT

A through hole 14 is provided in an earth terminal member 4 of an earth joint connector 1. A bolt 6 protruding from an external wall E is insertable into the through hole 14. A through hole 25 is also provided in a further earth terminal 5. The two earth terminals 4 and 5 are arranged to be attached to one another by fitting members 18 and 21 so that the earth terminals 4 and 5 do not rotate relative to each other. Thus the two earth terminals 4 and 5 can be connected to the external wall by a single nut 26 and bolt 6.

7 Claims, 4 Drawing Sheets

EARTH JOINT CONNECTOR

TECHNICAL FIELD

The present invention relates to an earth joint connector.

BACKGROUND TO THE INVENTION

FIGS. 5 and 6 of this specification show a conventional earth joint connector 40. The connector 40 is directly attached to an external wall E of an appliance, and serves to earth the circuit of a corresponding connector (not shown) which can be connected thereto. An attachment member 41 protrudes from the posterior end of the earth joint connector 40, the attachment member 41 having a through hole which is attachable to a bolt or stud 42 protruding from the external wall E. The connector 40 is retained against the wall E by a nut 43.

However, the earth joint connector 40 cannot reliably provide more than one earthing connection per bolt 42. In the case where a plurality of circuits are required to be earthed, it is considered necessary to locate separate earth joint connectors 40 on separate bolts 42.

The present invention has been developed after taking the above problem into consideration, and aims to present an earth joint connector that allows multiple circuits to be earthed via one earth connection with good reliability.

SUMMARY OF THE INVENTION

According to the present invention there is provided an earth joint connector comprising a connector housing having an earth joint protruding in a unified manner therefrom to the exterior of the connector housing, this protruding joint having an earth terminal formed thereon, the earth terminal being adapted for overlapping connection to another earth terminal.

In a preferred embodiment the earth terminal has a through hole for receiving a fixing bolt, a portion of the earth terminal having a rotation preventing member adapted for engagement with an attachment face, and for preventing rotation of the earth terminal relative to the attachment face.

The earth terminal may have fitting members engageable with corresponding fitting members on another earth terminal in order that the earth terminals may be retained in association with one another. The fitting members may overlap and have interengageable teeth and recesses to prevent movement of the earth terminals relative to one another.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
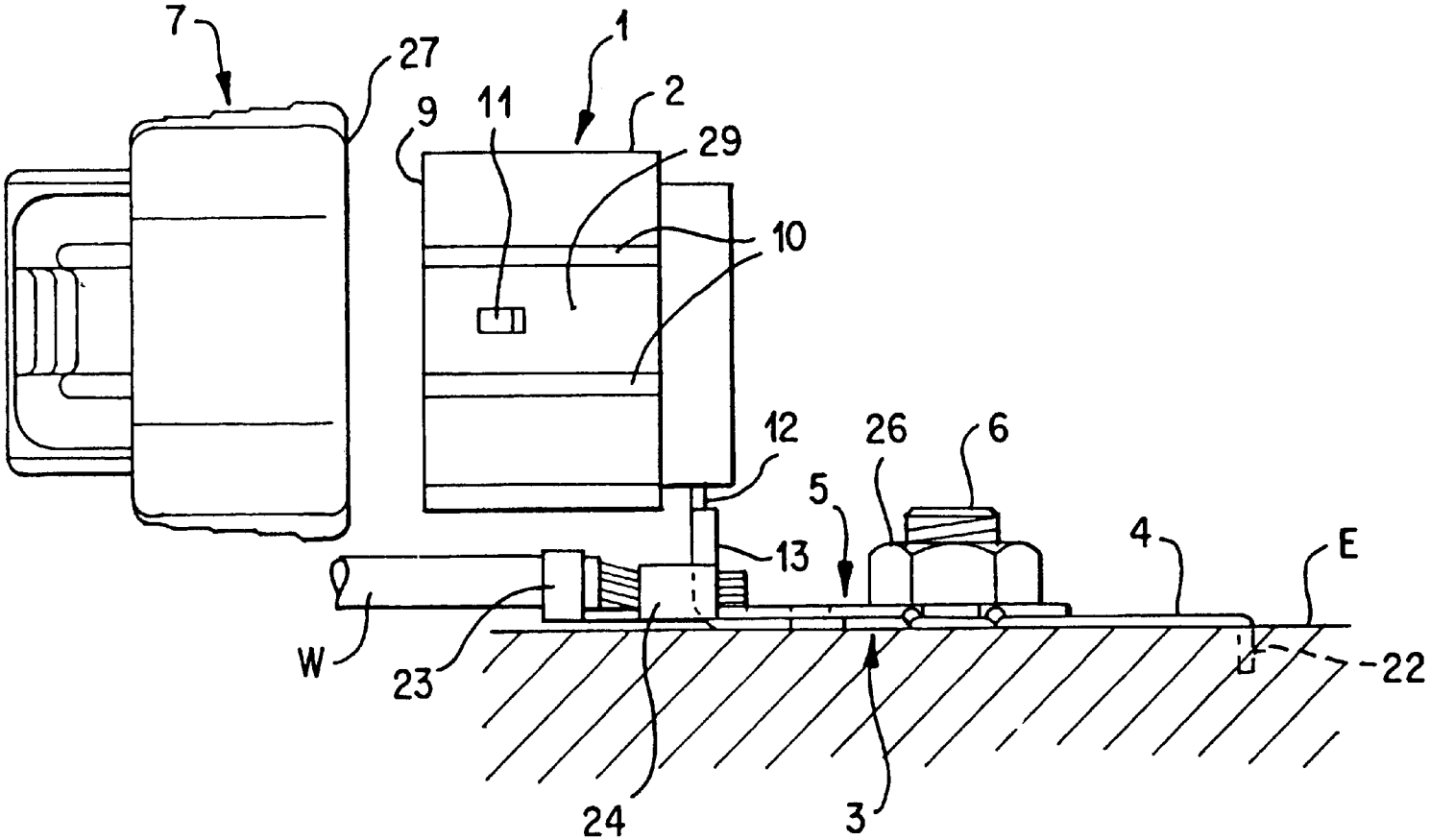
FIG. 1 is a side view prior to the attachment of an earth terminal to an earth joint connector.
Figure 2:
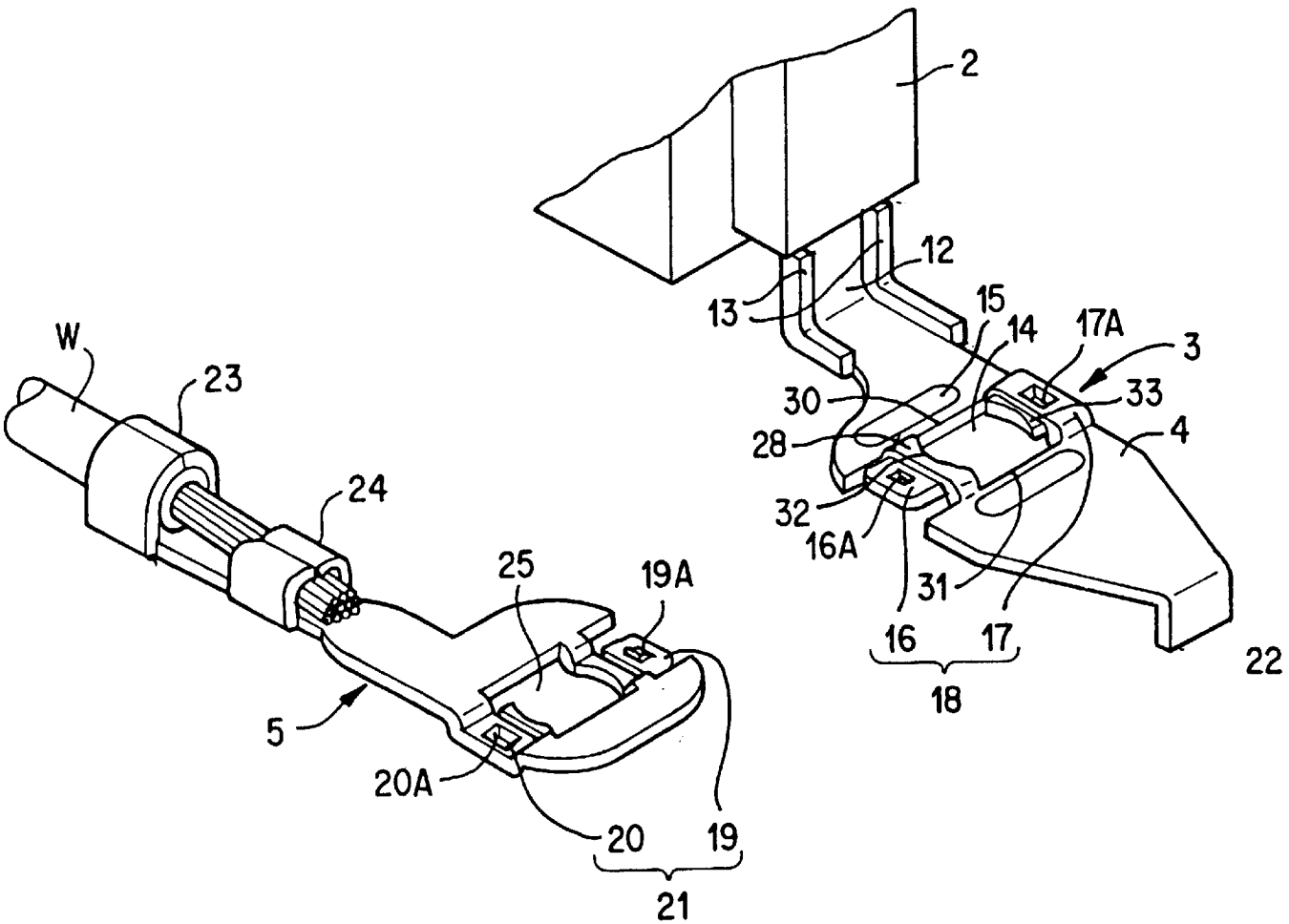
FIG. 2 is a perspective view prior to the attachment of a further earth terminal to an earth terminal of a connector housing.
Figure 3:
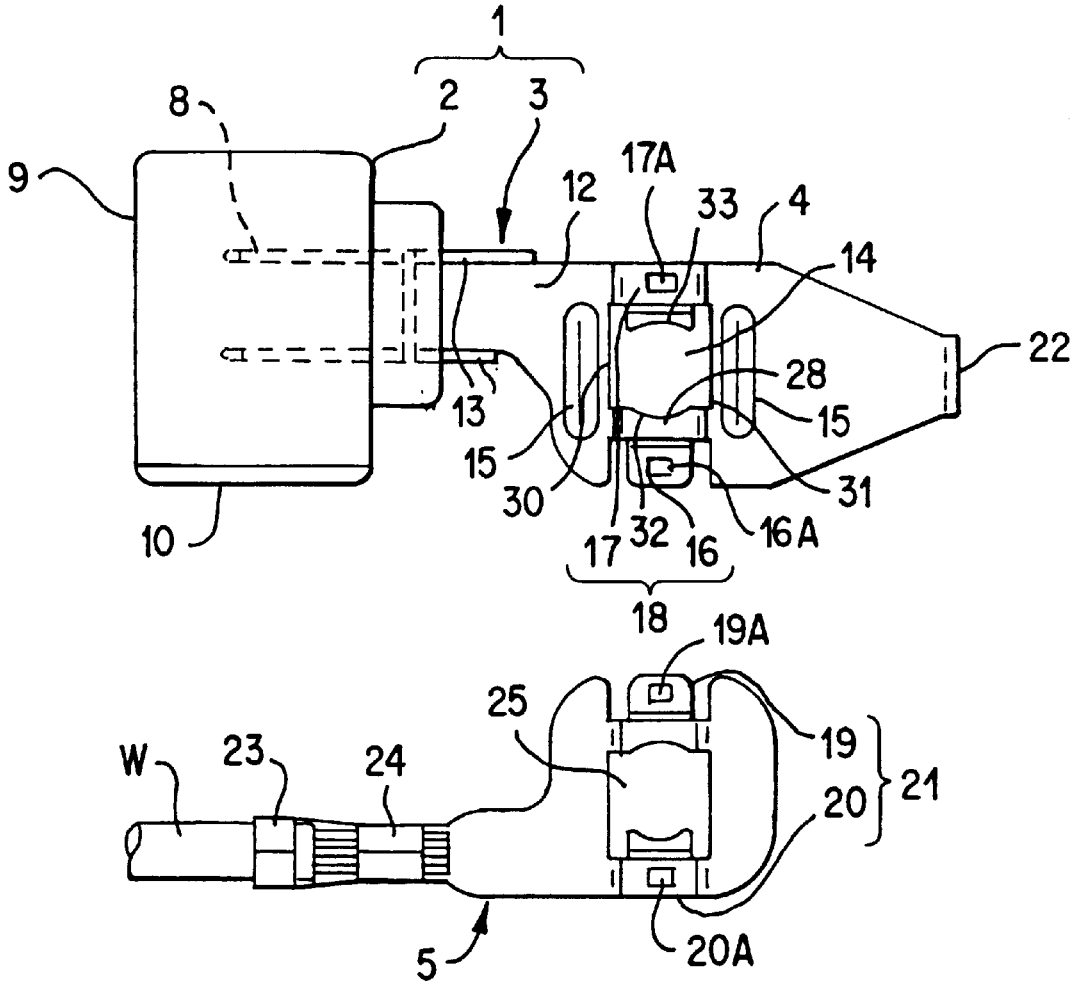
FIG. 3 is a plan view prior to the attachment of the further earth terminal to the earth terminal of the connector housing.
Figure 4:
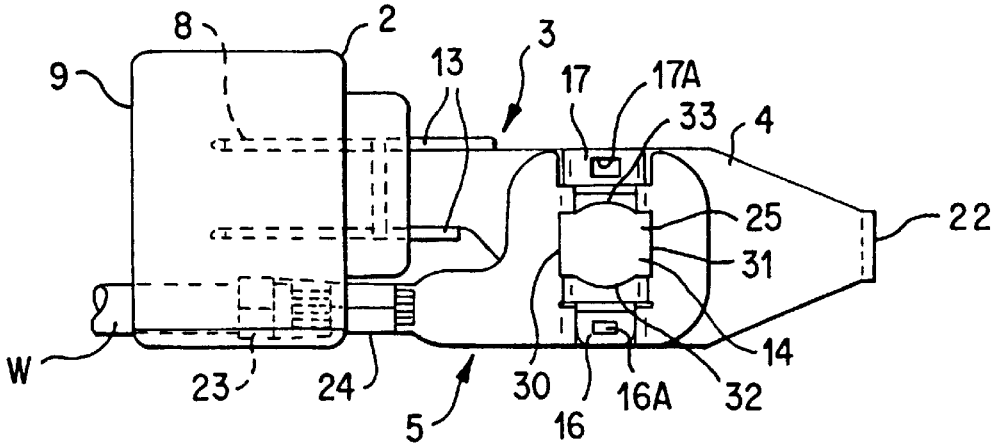
FIG. 4 is a plan view subsequent to the attachment of the further earth terminal to the earth terminal of the connector housing.
Figure 5:
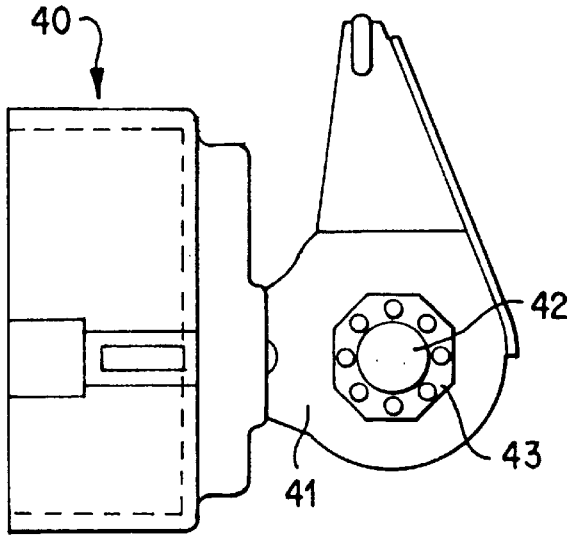
FIG. 5 PRIOR ART
FIG. 5 is a plan view of a conventional earth joint connector.
Figure 6:
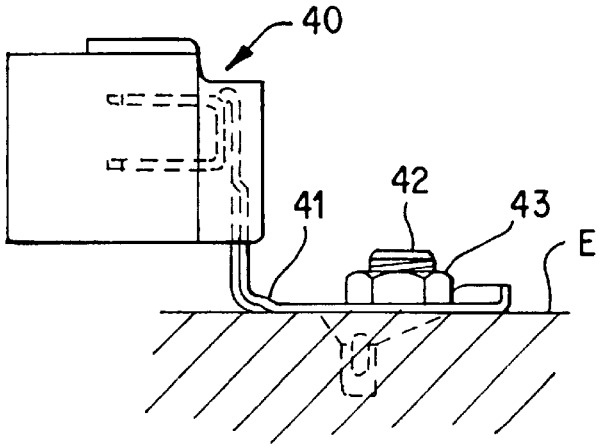
FIG. 6 PRIOR ART
FIG. 6 is a side view of the conventional earth joint connector.

An embodiment of the present invention is explained with reference to FIGS. 1 to 4.

An earth joint connector 1 comprises a connector housing 2 (this is a male connector housing in the present embodiment, but it can be embodied either as a male or a female connector housing), a joint terminal 3 protruding from this connector housing 2, an earth terminal member 4 formed in a unified manner with the joint terminal 3, and a further earth terminal 5 that is attached to the earth terminal member 4.

The earth joint connector 1 is attached to a bolt 6 protruding from an external wall E of a vehicle engine bay, or the like, and is used to earth a circuit (not shown) connected to a corresponding female connector 7.

The connector housing 2 is formed in a unified manner from synthetic resin into a rectangular solid shape, and fits into a hood member 27 of the corresponding female connector 7. A side face 29 (FIG. 1) of the connector housing 2 has two protrusions 10 extending in an anterior-posterior direction of the connector housing 2. The inner face of the female connector 7 has concave grooves (not shown) that correspond to the locations of the protrusions 10. These serve to guide the connectors 1 and 7 when fitting them together. A fitting protrusion 11 protrudes between the two protrusions 10 and fits into a fitting hole (not shown) in the female connector 7, to lock the two connectors 1 and 7 together.

The anterior face of the connector housing 2 is open, forming a fitting opening 9 that mates with the corresponding female connector 7. The connector housing 2 is substantially tubular in shape, and in the present embodiment, two horizontal rows and three vertical rows of male terminal members 8 protrude into its interior. The male terminal members 8 are formed by bending part of the joint terminal 3, and are assembled in a uniform manner by insertion moulding with the connector housing 2.

Although the details of the entire joint terminal 3 are not shown in the diagrams, as described earlier its anterior end has a male terminal members 8 protruding therefrom. The central portion has a supporting member 12 that supports the earth joint connector 1 at a specified height from the external wall E, and its posterior end has the earth terminal member 4 protruding therefrom.

The space provided between the connector housing 2 and the external wall E by means of the supporting member 12 is necessary to allow fitting of the female connector 7 to the earth joint connector 1. Moreover, it also allows an electric wire W extending to another earth terminal 5 access to the bolt 6 (in this embodiment, the electric wire W passes under the connector housing 2). Both the edges extending from the supporting member 12 to the earth terminal member 4 have upward-bending L-shaped strengthening members 13 for strengthening this portion.

The earth terminal member 4 serves to attach the earth joint connector 1 to the bolt 6 protruding from the external wall E. The centre of the earth terminal member has a through hole 14 to allow the bolt 6 to receive terminal member 4 inserted therethrough. The hole 14 has opposing parallel edges 30,31 and opposing circular edges 32,33.

Adjacent to the parallel edges 30,31 of the through hole 14 raised projections 15 are formed on a face (the upper face) that fits with a further earth terminal 5. The projections 15 serve to ensure a good connection between the earth terminal member 4 and the further earth terminal 5. The outer sides of the partially circular edges 32,33 of the through hole 14 have fitting members 18 formed on an elevated plane that engage the further earth terminal 5. One of these fitting members 18 forms a tongue 16 that extends outwards from a bridge member 28. The other fitting member 18 forms a platform 17 at the same height as the bridge member 28. Further, the tongue 16 has spaces formed on both of its sides, these spaces allowing the further earth terminal 5 to be attached therein, and allowing the tongue 16 to be bendable in an upward direction. A protrusion or interengaging tooth 16A projects downwardly from the centre of the tongue 16, this protrusion 16A fitting with a corresponding hole 20A provided in an extending member 20 of the further earth terminal 5. The centre of the platform 17 has a fitting hole 17A opened out therefrom, a protrusion or interengaging tooth 19A extending from a protruding member 19 on the further earth terminal 5 fitting therewith.

In this manner, the fitting member 18 fits with the fitting member 21 of the earth terminal 5, and the connectors 1 and 7 are fitted together unremovably.

The anterior end of the earth terminal member 4 is bent downwards approximately at a right angle thus forming a rotation preventing member 22 which fits with a groove member (not shown) provided in the external wall E. This prevents the earth terminal member 4 from rotating when it is tightened by means of the bolt 6 and the nut 26.

The further earth terminal 5 is simultaneously attached to the bolt 6 having the earth joint connector 1 attached thereto, the earth terminal 5 being located above the earth terminal member 4. The further earth terminal 5 is formed by bending an electrically conductive metal plate, its posterior side having two anterior and posterior barrels 23 and 24. A covered wire W is fixed in place by means of the barrels 23 and 24. The posterior barrel is an insulation barrel 23 for clamping the covered portion of the covered wire W, and the anterior barrel is a wire barrel 24 for clamping the core wire located in a central portion of the covered wire W.

The further earth terminal 5 has a through hole 25 that allows the bolt 6 to be passed through it, its periphery having a configuration similar to the periphery of the through hole 14 of the earth terminal member 4. In other words, one side of the through hole 25 has a tongue 19 formed thereon, the other side having a platform 20. The tongue 19 and platform 20 of the further earth terminal 5 are formed at a lower plane than the other parts. For this reason, the fitting members 18 and 21 of the earth terminal member 4 and the earth terminal 5 mutually fit together.

In order to attach the further earth terminal 5 to the earth terminal member 4, first both are brought together so as to insert the respective protruding members 16 and 19 into the respective through holes 25 and 14. Next, the earth terminal member 4 and the earth terminal 5 are made to slide so that the respective protrusions 16A and 19A approach the corresponding fitting holes 20A and 17A. At this juncture, the protruding members 16 and 19 bend up and then down and fit with the extending members 20 and 17. When this is done, the protruding members 16A and 19A fit into the fitting holes 20A and 17A. The protruding members 16 and 19 thus revert to their original shape, and the earth terminal member 4 and the further earth terminal 5 are held in an unremovable and non-rotatable manner (see FIGS. 3 and 4). At this juncture, the direction of the electric wire W attached to the further earth terminal 5 and the direction of opening of the fitting opening 9 of the connector housing 2 are the same.

The operation and effects of the embodiment as described above are now explained.

First, an electric wire W, with the covering of its anterior end removed and the core wire exposed, is clamped to the two barrels 23 and 24 of the further earth terminal 5.

Next, the earth terminal 5 and the earth terminal member 4 are attached in the manner described above.

Then, the bolt 6 protruding from the external wall E of the appliance is passed through the through holes 14 and 25 of the terminals 4 and 5, and these are assembled with the rotation preventing member 22 fitting into the groove member (not shown) of the external wall E. Then, by tightening the nut 26 on the bolt 6, the attachment of the earth joint connector 1 is completed.

A female connector 7 (see FIG. 1) is attached to the earth joint connector 1 assembled as described above, thereby earthing a circuit attached to the female connector 7.

In this manner, according to the present embodiment, the further terminal 5 connected to another circuit is attached to the earth terminal member 4 of the earth joint connector 1, thereby resulting in simultaneous earthing at one location. Since a plurality of circuits can be earthed at one location, the attachment operation is simplified, and the required number of earthing locations reduced.

Further, since the rotation preventing member of the earth terminal member 4 fits with the external wall E (attachment face) of the appliance, when the fixing bolt 6 is tightened, the earth terminal member 4 does not rotate.

Moreover, since the earth terminal member 4 and the other earth terminal 5 are fitted together by means of the fitting members 18 and 21, there is no possibility of the two terminals 4 and 5 moving relative to one another during use. For this reason, a good earth connection is maintained.

Furthermore, since the earth terminal member 4 and the earth terminal 5 are fitted together, on the earth joint connector 1 it is necessary to provide only one rotation preventing member 22 which prevents rotation with respect to the external wall E.

The present invention is not limited to the embodiments described above. For example, the possibilities described below also lie within the technical range of the present invention.

(1) The rotation preventing member may be provided on the further earth terminal 5 rather than on the earth terminal 4 of the earth joint connector 1.

(2) The number of earth terminals attached to the bolt 6 need not be limited to two and may be any number. Moreover, in such a case, a fitting member should be provided for preventing relative rotation of each earth terminal.

What is claimed is:

1. An earth joint connector comprising a connector housing and an earth joint including at least one terminal member within the housing, said earth joint protruding from the connector housing and having a first earth terminal formed thereon outside of said housing, the first earth terminal having a planar portion with a through hole for receiving a fixing bolt, and at least one folded fitting member folded from the planar portion, each fitting member extending outside a plane of the planar portion and adapted to engage and hold a second overlying earth terminal, wherein the planar portion of the first earth terminal has an abutment adapted for engagement with an earthing member and for preventing arcuate movement of the first earth terminal about the axis of the through hole, wherein a portion of the earth joint is turned at approximately a right angle to define a bend between the first earth terminal and the connector housing, opposite edges of said portion being upturned to strengthen said bend.

2. The connector of claim 1, wherein the first earth terminal is planar, and the connector housing is spaced to one side of the plane of the first earth terminal.

3. The connector housing of claim 1, wherein the first earth terminal has upstanding projections for contact with an overlapping second earth terminal.

4. The connector housing of claim 1 and further including a second overlying earth terminal, the first and second earth terminals having interengageable fitting members in order to retain the first and second earth terminals in connection with one another.

5. The connector of claim 4, wherein a connecting wire of said overlying second earth terminal is adapted to extend in the same direction as said connector housing.

6. The connector of claim 4 wherein the fitting members are adapted to overlap one another.

7. The connector of claim 6, wherein the fitting members include interengageable teeth and recesses to prevent movement of the first and second earth terminals relative to one another.

* * * * *